US010470531B1

(12) United States Patent
Yanes

(10) Patent No.: US 10,470,531 B1
(45) Date of Patent: Nov. 12, 2019

(54) CHARMS FOR HEADGEAR

(71) Applicant: Daniel Francisco Yanes, Miami, FL (US)

(72) Inventor: Daniel Francisco Yanes, Miami, FL (US)

( * ) Notice: Subject to any disclaimer, the term of this patent is extended or adjusted under 35 U.S.C. 154(b) by 0 days.

(21) Appl. No.: 16/355,312

(22) Filed: Mar. 15, 2019

(51) Int. Cl.
*A44C 1/00* (2006.01)
*A44C 15/00* (2006.01)

(52) U.S. Cl.
CPC ..... *A44C 1/00* (2013.01); *A44C 15/006* (2013.01)

(58) Field of Classification Search
CPC . Y10T 24/13; Y10T 24/1365; Y10T 24/1394; A44C 1/00; A44C 15/006; A44B 1/38
See application file for complete search history.

(56) References Cited

U.S. PATENT DOCUMENTS

| | | | | |
|---|---|---|---|---|
| 3,088,295 | A * | 5/1963 | Haines | A44B 1/04 63/20 |
| 3,735,447 | A | 5/1973 | Abraham | |
| 6,122,805 | A | 9/2000 | Haegley | |
| 6,178,680 | B1 | 1/2001 | Sloot | |
| 6,675,512 | B1 | 1/2004 | Shwartz et al. | |
| 6,701,649 | B1 | 3/2004 | Brosi | |
| D558,955 | S | 1/2008 | Taylor | |
| D603,584 | S | 11/2009 | Porter | |
| 7,640,636 | B2 | 1/2010 | Clark | |
| 8,001,661 | B2 | 8/2011 | Clark | |
| 9,259,045 | B1 | 2/2016 | Yanes et al. | |
| 9,955,744 | B1 | 5/2018 | Yanes et al. | |
| 2008/0141440 | A1 | 6/2008 | Taylor | |
| 2010/0064484 | A1 | 3/2010 | Clark | |

FOREIGN PATENT DOCUMENTS

| | | | |
|---|---|---|---|
| WO | 2005120266 | A1 | 12/2005 |

* cited by examiner

*Primary Examiner* — Jack W Lavinder
(74) *Attorney, Agent, or Firm* — Albert Bordas, P.A.

(57) ABSTRACT

Charms for headgear having a charm, at least one post retainer assembly having a base and a convex structure, and securing means having at least one post assembly to secure the charm onto a headgear. The charm receives the at least one post retainer assembly, and the at least one post retainer assembly receives respective post assembly. The charm has an exterior face and an interior face. The interior face has at least one hole. The convex structure extends from the base and has an opening. The base is inserted into the at least one hole and remains secured therein, and the convex structure is exposed at the hole. The at least one post assembly removably mounts into the at least one post retainer assembly. The charm has a variety of shapes, whereby the exterior face defines a plurality of designs.

17 Claims, 7 Drawing Sheets

CHARMS FOR HEADGEAR

BACKGROUND OF THE INVENTION

1. Field of the Invention

The present invention relates to headgear accessories, and more particularly, to charms for headgear.

2. Description of the Related Art

Applicant believes that one of the closest references corresponds to U.S. Pat. No. 9,955,744 issued to applicant's own Yanes, et al. on May 1, 2018 for Pinned plate assembly. However, it differs from the present invention because Yanes, et al. teach a pinned plate assembly having a plate assembly made of a flexible and bendable semi rigid material that maintains its shape once configured. The plate assembly has an exterior face, an interior face, first and second edges, and first and second lateral edges. The plate assembly further has first and second channels, each having at least one hole. Securing means secure the plate assembly onto headgear. In a preferred embodiment, the plate assembly has a substantially rectangular shape. The exterior face displays desired text, and/or letters, and/or symbols, and/or words, and/or logo designs, and/or artwork, and/or graphics. The first and second channels each have an exterior channel defined at the exterior face and an interior channel defined at the interior face. The at least one hole extends from the exterior channel to the interior channel.

Applicant believes that another reference corresponds to U.S. Pat. No. 9,259,045 issued to applicant's own Yanes, et al. on Feb. 16, 2016 for Pinned plate assembly. However, it differs from the present invention because Yanes, et al. teach a pinned plate assembly having a plate assembly and post assemblies. The plate assembly mounts onto headgear without affecting the integrity of the headgear by utilizing existing eyelets to receive the post assemblies therethrough. The plate assembly is made of a flexible and bendable semi rigid material that maintains its shape once configured. The plate assembly has an exterior face, an interior face, first and second edges, first and second lateral edges, and an advertisement band section mounted onto the exterior face. The advertisement band section displays desired first text, and/or first letters, and/or first symbols, and/or first words, and/or first logo designs, and/or first artwork, and/or first graphics. The interior face has two apertures with respective aperture frames disposed at predetermined distances from respective corners defined by the first edge and the first and second lateral edges to receive the post assemblies.

Applicant believes that another reference corresponds to U.S. Patent Application Publication No. 20080141440 A1, published on Jun. 19, 2008 to Taylor for Headgear with a Projected Design Element. However, it differs from the present invention because Taylor teaches embodiments for a headgear, such as a hat or visor, that includes a top portion, a sidewall extending downwardly from the top portion, and a design element attached to and spaced apart from the sidewall. The design element has a front surface and a back surface. The back surface of the design element is adjacent, spaced apart from, and co-facing the sidewall, and the front surface of the design element faces outwardly from the sidewall. The design element is spaced apart from the sidewall using one or more rods that project from the sidewall. The design element may comprise a logo, one or more letters, one or more words, or one or more numbers.

Applicant believes that another reference corresponds to U.S. Patent Application Publication No. 20100064484 A1, published on Mar. 18, 2010 to Clark, and corresponding U.S. Pat. No. 8,001,661 B2 issued on Aug. 23, 2011 for Apparatus for Securing Ornamentation to Personal Items. However, it differs from the present invention because Clark teaches an ornamental device that includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

Applicant believes that another reference corresponds to U.S. Pat. No. 7,640,636 B2 issued to Clark on Jan. 5, 2010 for Apparatus for Securing Ornamentation to Personal Items. However, it differs from the present invention because Clark teaches an ornamental device that includes a first member adapted to be coupled to a personal item. The first member has a first end having a sidewall. A second member is releasably engagable with the first member, and is provided with a recess that receives the first end of the first member when the first and second members are engaged. The second member has a flange that contacts the sidewall of the first member substantially along a width of the sidewall when the first and second members are engaged. The first and second members are magnetically coupled, such that the magnetic interaction, and the interaction of the flange with the sidewall, secures a decorative second member to a personal item in a selected location.

Applicant believes that another reference corresponds to U.S. Pat. No. 6,701,649 B1 issued to Brosi on Mar. 9, 2004 for Combat Identification Marker. However, it differs from the present invention because Brosi teaches a marker for attachment to a helmet head covering or the like of a friendly force member, and more particularly to an on-the-go hand securable marker having at least one extension with a retaining head for inserting into a hole in the uniform with the retaining head sufficiently rigid to prevent withdrawal therefrom under field conditions with the marker having a limited wavelength reflective surface thereon to enable a person observing under nighttime conditions to determine if a person is a friendly force member by the presence of reflections of electromagnetic radiation from the marker on the friendly force member. If field conditions change one can quickly remove the marker and replace the marker with conventional camouflage materials.

Applicant believes that another reference corresponds to U.S. Pat. No. 6,675,512 B1 issued to Shwartz, et al. on Jan. 13, 2004 for Display Assembly for Placement on Clothing Apparel. However, it differs from the present invention because Shwartz, et al. teaches a display assembly for placement on apparel. The assembly includes a flexible layer for placement against the apparel. The assembly further includes a display having pliable extension for penetrating across the flexible layer to securely position the display on the flexible layer. The assembly can be attached to the apparel, including a cap and visor by stitching or sewing the flexible layer to the apparel.

Applicant believes that another reference corresponds to U.S. Pat. No. 6,178,680 B1 issued to Sloot on Jan. 30, 2001 for Applique for Apparel and Method for Making the Applique. However, it differs from the present invention because Sloot teaches an applique and method for making it, wherein inner and outer vinyl sheets are welded together to form a decorative applique and wherein a pair of fastener are employed each having a flat segment that is embedded between the inner and outer vinyl sheets and has a stem that extends through the inner sheet, its outer located adhesive layer and overlying release liner. Caps are used to enable the applique to be affixed to a carrier card for shipment to an end user, who can then remove the caps and use the fasteners to affix the applique to apparel using the adhesive and re-use the fasteners. The combination of the adhesive and the fasteners enable a firm and sustaining attachment of the applique to surfaces having a low affinity to the adhesive employed on the inner layer.

Applicant believes that another reference corresponds to U.S. Pat. No. 6,122,805 A issued to Haegley on Sep. 26, 2000 for Device for Securing Ribbons to Military Uniform. However, it differs from the present invention because Haegley teaches a securing device to be located on the inside of a uniform garment to align and anchor military-type ribbon holders, nametags and warfare insignias. The securing device contains claps encased within a thin, soft, pliable plastic foam material sized slightly larger than the secured military-type ribbon holders, nametags and warfare insignias, yielding a flush appearance against the wearer's body. Repeated insertion to and retraction from my device can occur without concern for lost clasps or skin penetration.

Applicant believes that another reference corresponds to U.S. Pat. No. 3,735,447 A issued to Abraham on May 29, 1973 for Holder and Fastener. However, it differs from the present invention because Abraham teaches a device for holding an object and fastening same in a desired location. For example, the device may be used for securing a corsage or the like to an item of wearing apparel. The device includes a first element comprising a first body member adapted to have a corsage secured thereto and means defining a socket integrally connected to the first body member. The device further includes a second element comprising a second body member and fastener means in the form of pins projecting outwardly therefrom. When the device is used in conjunction with a corsage, the second element is adapted for disposition on the inside of the wearing apparel with the fastener pins adapted to pierce the wearing apparel and enter the socket of the first element to effect releasable engagement therebetween.

Applicant believes that another reference corresponds to U.S. Pat. No. D558,955 S issued to Taylor on Jan. 8, 2008 for Head Gear with Projecting Indicia. However, it differs from the present invention because Taylor teaches an ornamental design for a head gear with projecting indicia that is different from Applicant's invention.

Applicant believes that another reference corresponds to U.S. Pat. No. D603584S issued to Porter on Nov. 10, 2009 for Headwear Device. However, it differs from the present invention because Porter teaches an ornamental design for a headwear device that is different from Applicant's invention.

Applicant believes that another reference corresponds to PCT Publication No. WO2005120266 A1 published by WIPO to Thompson on Dec. 22, 2005 to Taylor for Instant Wearable Cap Bill Shaper with Indicia. However, it differs from the present invention because Thompson teaches a curved cap bill shaper that has binding tabs, snaps, spikes, or adjustable snaps at each end binding the side edges of a cap bill to the bill shaper and imparting a desired curvature to the cap bill. Mating curved arms hinged to the bill shaper may adjustably interlock below the cap bill sandwiching it therebetween. Protruding points from the bill shaper and the arms may pierce or indent the cap bill. Indicia may be placed on a top surface of the bill shaper, which covers or partly covers the cap bill.

Other patents describing the closest subject matter provide for a number of more or less complicated features that fail to solve the problem in an efficient and economical way. None of these patents suggest the novel features of the present invention.

SUMMARY OF THE INVENTION

The present invention is charms for headgear comprising a charm, at least one post retainer assembly comprising a base and a convex structure, and securing means comprising at least one post assembly to secure the charm onto a headgear.

The charm comprises an exterior face and an interior face. The charm receives the at least one post retainer assembly, and the at least one post retainer assembly receives a respective post assembly. The interior face comprises at least one hole. The base comprises straight sides and curved sides. The straight sides are opposite each other, and the curved sides are opposites each other.

The convex structure extends from the base and comprises an opening. The opening comprises and opening edge. The opening edge is plane and parallel to the base. The convex structure further comprises elongated apertures. The elongated apertures extend from the base to the opening.

The at last one post assembly comprises a backing, extending from the backing is a post having a head at its distal end. The at least one hole is of a cooperative shape and dimension to removably receive the respective post retainer assembly. The base is inserted into the at least one hole and remains secured therein and the convex structure is exposed at the hole. The at least one post assembly removably mounts into the at least one post retainer assembly.

The opening is of a cooperative shape and dimension to removably receive and retain the head. The charm mounts onto the headgear without affecting integrity of the headgear by utilizing existing eyelets to receive the at least one post assembly.

The charm mounts onto the headgear when the respective post retainer assembly is inserted into the charm and the opening is aligned with the eyelet, then from an interior section of the headgear crown, the head pass through the eyelet until respective opening receive respective head.

The charm may be of different, or any variety of shapes, whereby the exterior face defines a plurality of designs. Securing means to secure the charm onto the headgear comprises a tension arm assembly.

It is therefore one of the main objects of the present invention to provide a charm to mount onto headgear for customization.

It is another object of the present invention to provide charms, which are mounted onto the headgear without affecting the headgear's integrity by utilizing existing headgear eyelets to receive post assemblies therethrough.

It is another object of the present invention to provide charms for headgear that comprises a post retainer assembly and a post assembly.

It is another object of the present invention to provide charms for headgear that comprise a plurality of shapes and designs.

It is another object of the present invention to provide charms for headgear that are volumetrically efficient for carrying, transporting, and storage.

It is another object of the present invention to provide charms for headgear that can be readily assembled and disassembled without the need of any special tools.

It is another object of the present invention to provide charms for headgear that are of a durable and reliable construction.

It is another object of this invention to provide such charms for headgear that are inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
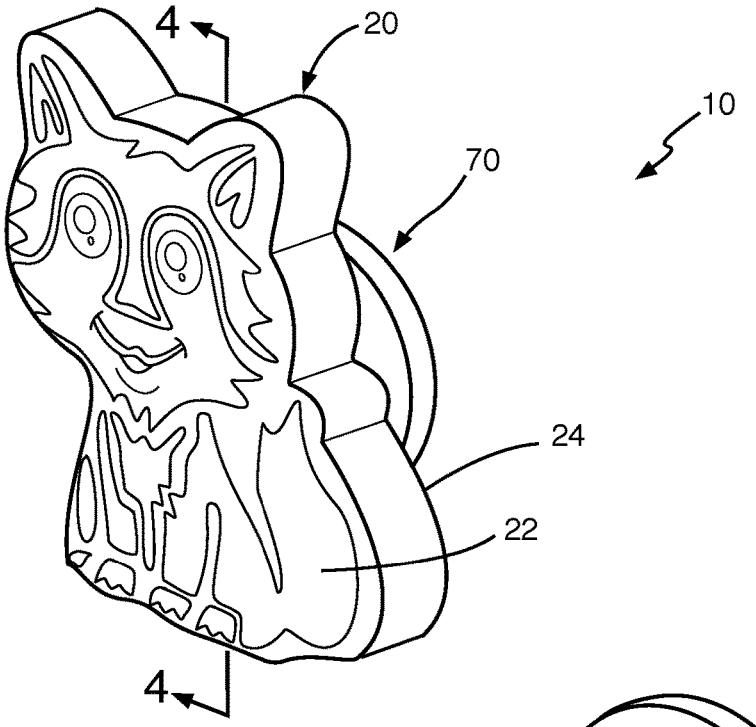
FIG. 1 is an isometric view of the present invention with a post assembly.

Referring now to the drawings, the present invention is charms for headgear, and is generally referred to with numeral 10. It can be observed that it basically includes charm 20, post retainer assembly 40, and post assembly 70.

As seen in FIG. 1, present invention 10 comprises charm 20, which is secured with post assembly 70.

Charm 20 may be of any desired shape or any variety of shapes, whereby exterior face 22 defines any design. Such a design for example may be a wolf, cat, flag with eagle, truck, etc. or any desired text, and/or letters, and/or symbols, and/or words, and/or logo designs, and/or artwork, and/or graphics.

Figure 2:
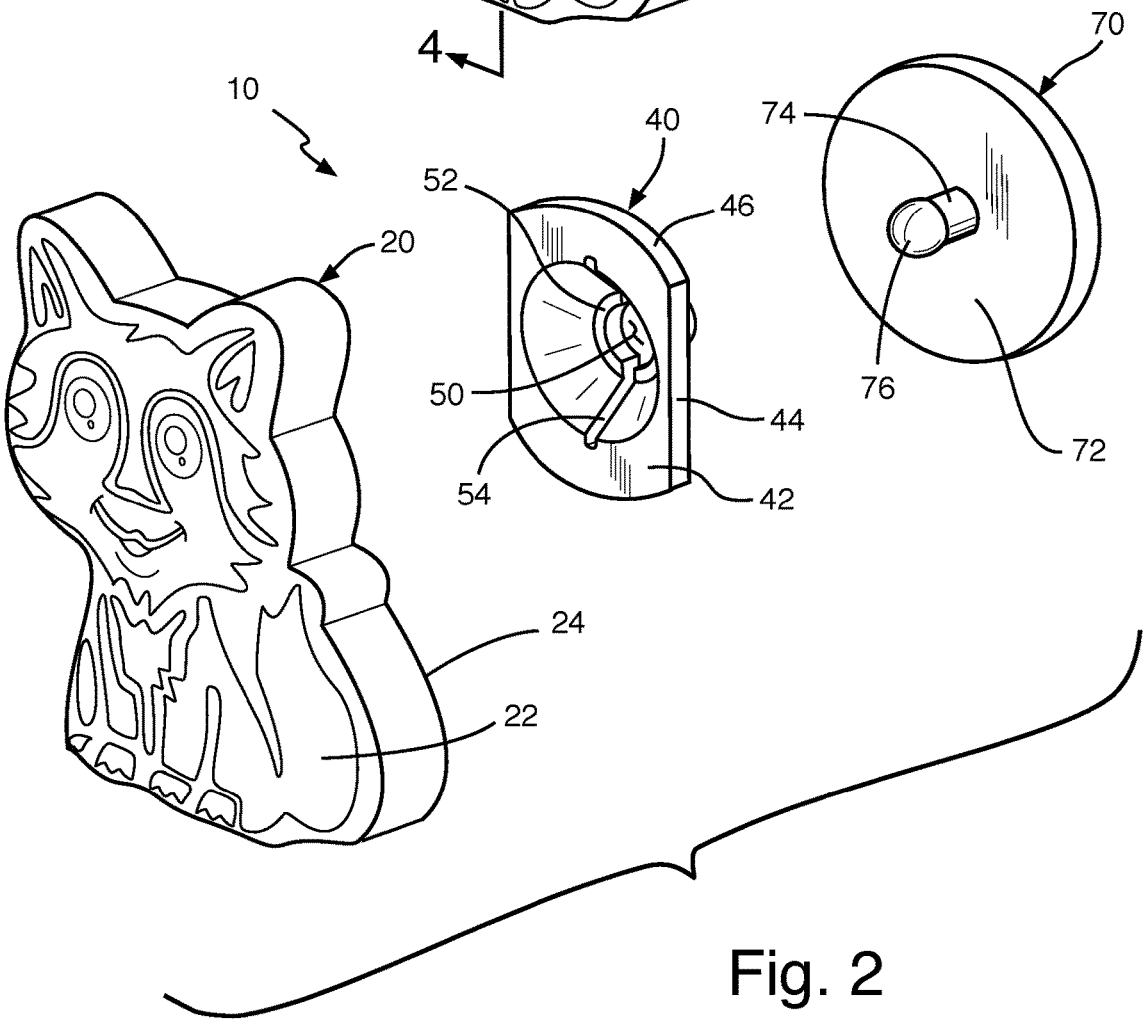
FIG. 2 is a front exploded view of the present invention with the post assembly.
Figure 3:
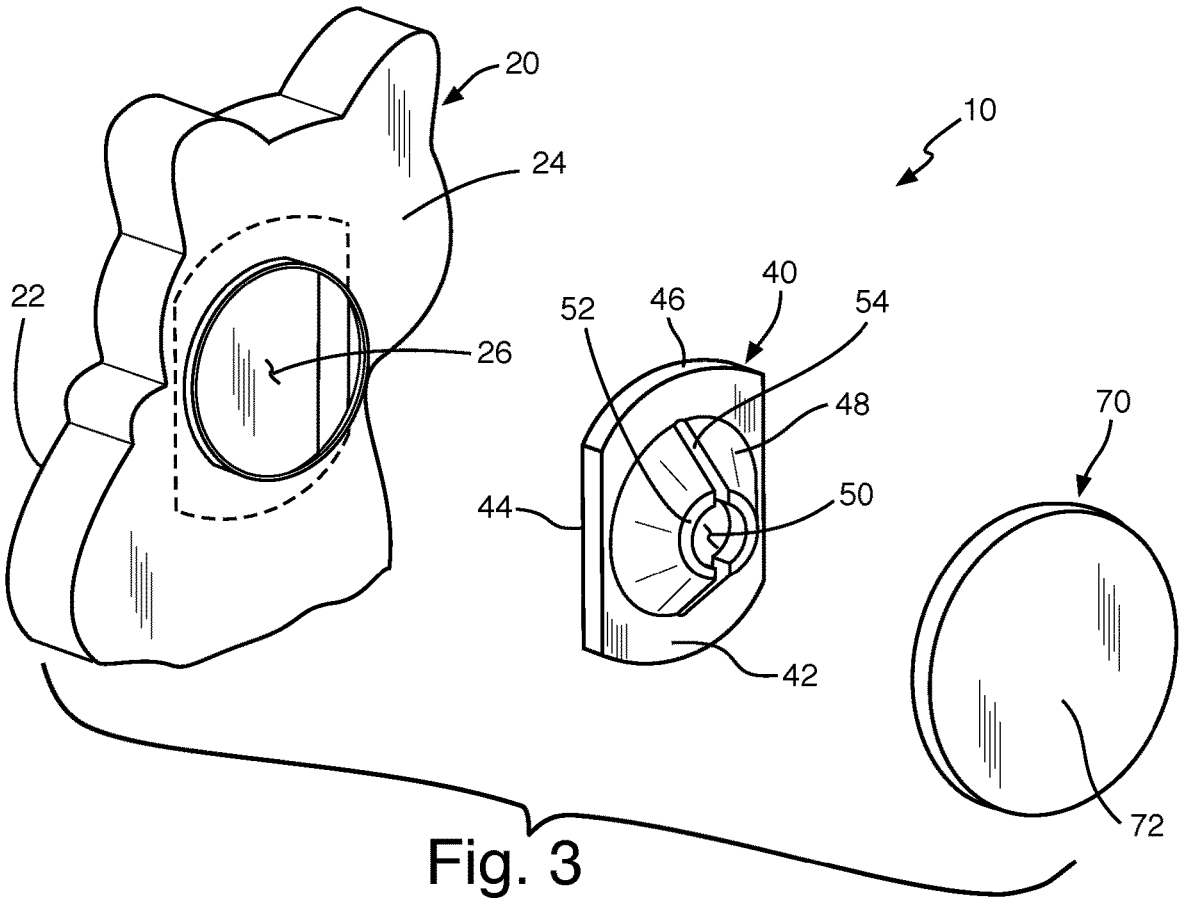
FIG. 3 is a rear exploded view of the present invention with the post assembly.

As seen in FIGS. 2 and 3, charm 20 comprises exterior face 22 and interior face 24. Post retainer assembly 40 comprises base 42. Base 42 comprises straight sides 44 and curved sides 46. Straight sides 44 are opposite each other, and curved sides 46 are opposite to each other.

Post assembly 70 comprises backing 72, and extending from backing 72 is post 74 having head 76 at its distal end.

As seen in FIG. 3, interior face 24 comprises at least one hole 26. Post retainer assembly 40 further comprises convex structure 48 that extends from base 42. Convex structure 48 comprises opening 50. Opening 50 comprises opening edge 52. Opening edge 52 is plane and parallel to base 42.

Convex structure 48 further comprises elongated apertures 54. Elongated apertures 54 extend from base 42 to opening 50. In a preferred embodiment, there are two elongated apertures 54.

Figure 4:
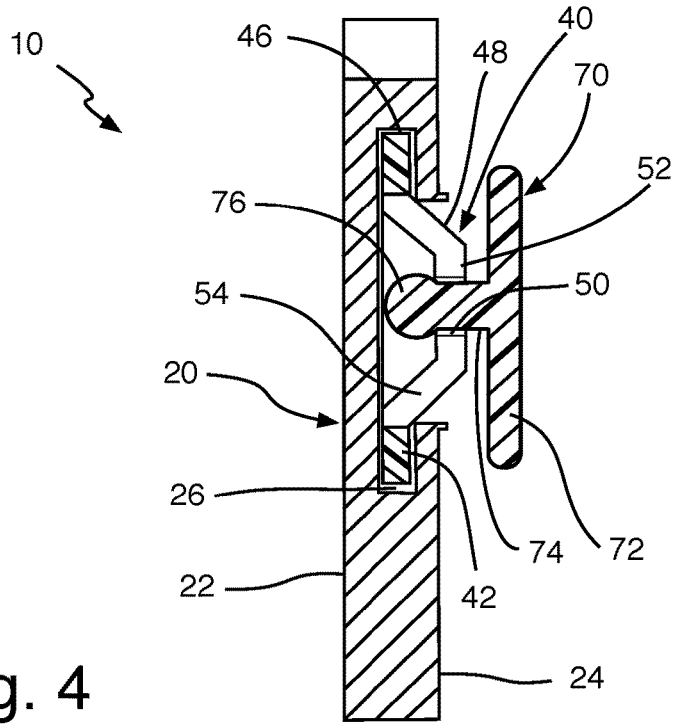
FIG. 4 is a cut view taken along lines 4-4 from FIG. 1.

As seen in FIG. 4, charm 20 receives at least one post retainer assembly 40, and at least one post retainer assembly 40 receives respective post assembly 70.

Base 42 is inserted into hole 26 and remains secured therein, and convex structure 48 is exposed at hole 26. Hole 26 is of a cooperative shape and dimension to removably receive respective post retainer assembly 40, and specifically base 42. Post assembly 70 removably mounts into post retainer assembly 40, whereby opening 50 is of a cooperative shape and dimension to removably receive and retain head 76. It is noted that a predetermined force is required for opening 50 to receive respective head 76.

Figure 5:
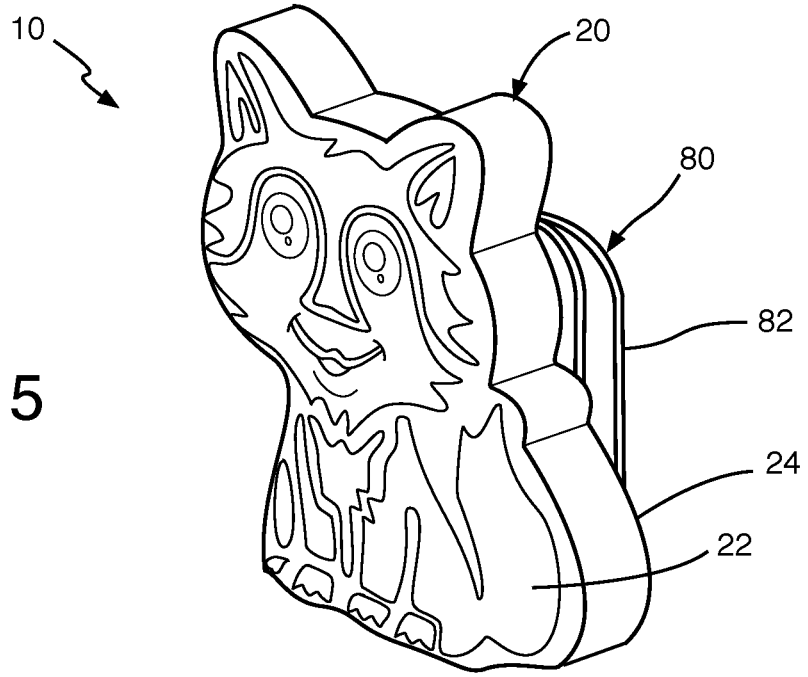
FIG. 5 is an isometric view of the present invention with a tension arm assembly.
Figure 6:
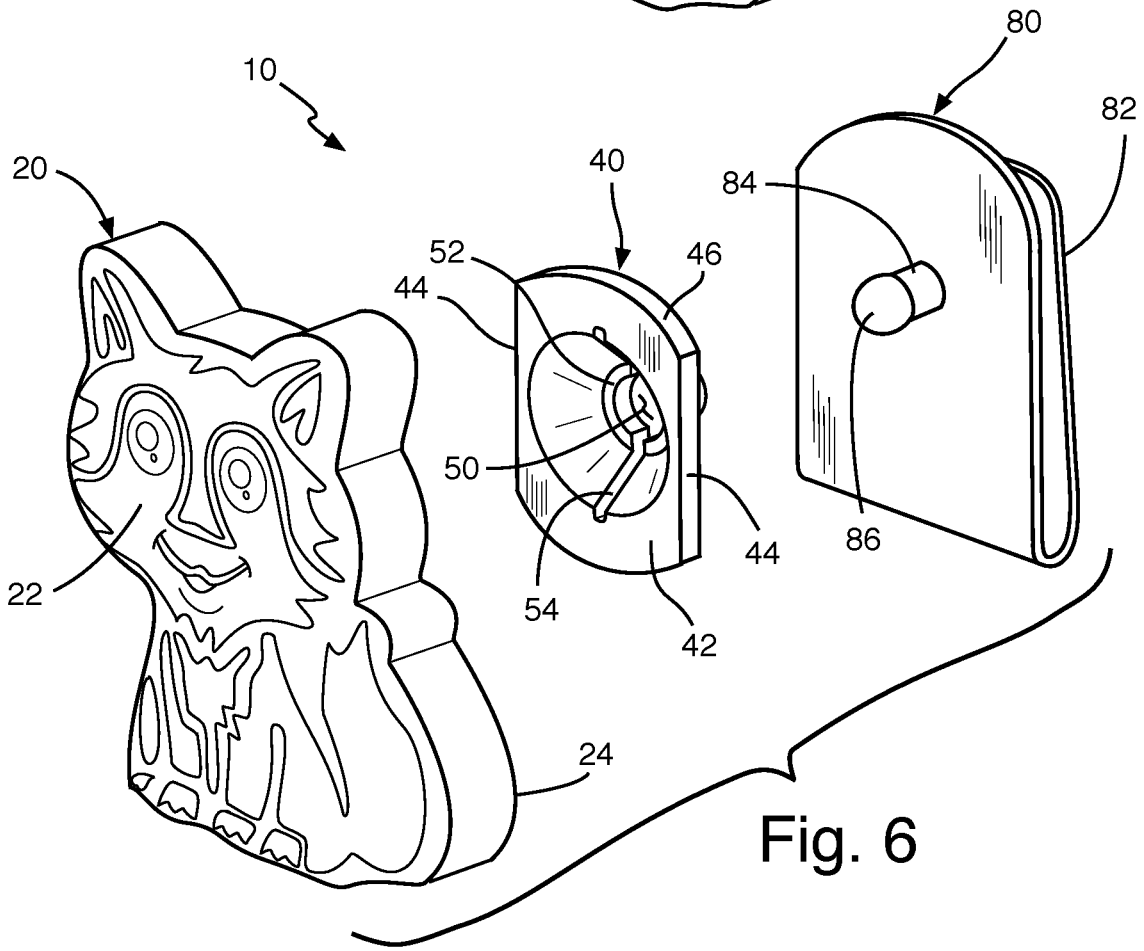
FIG. 6 is a front exploded view of the present invention with the tension arm assembly.
Figure 7:
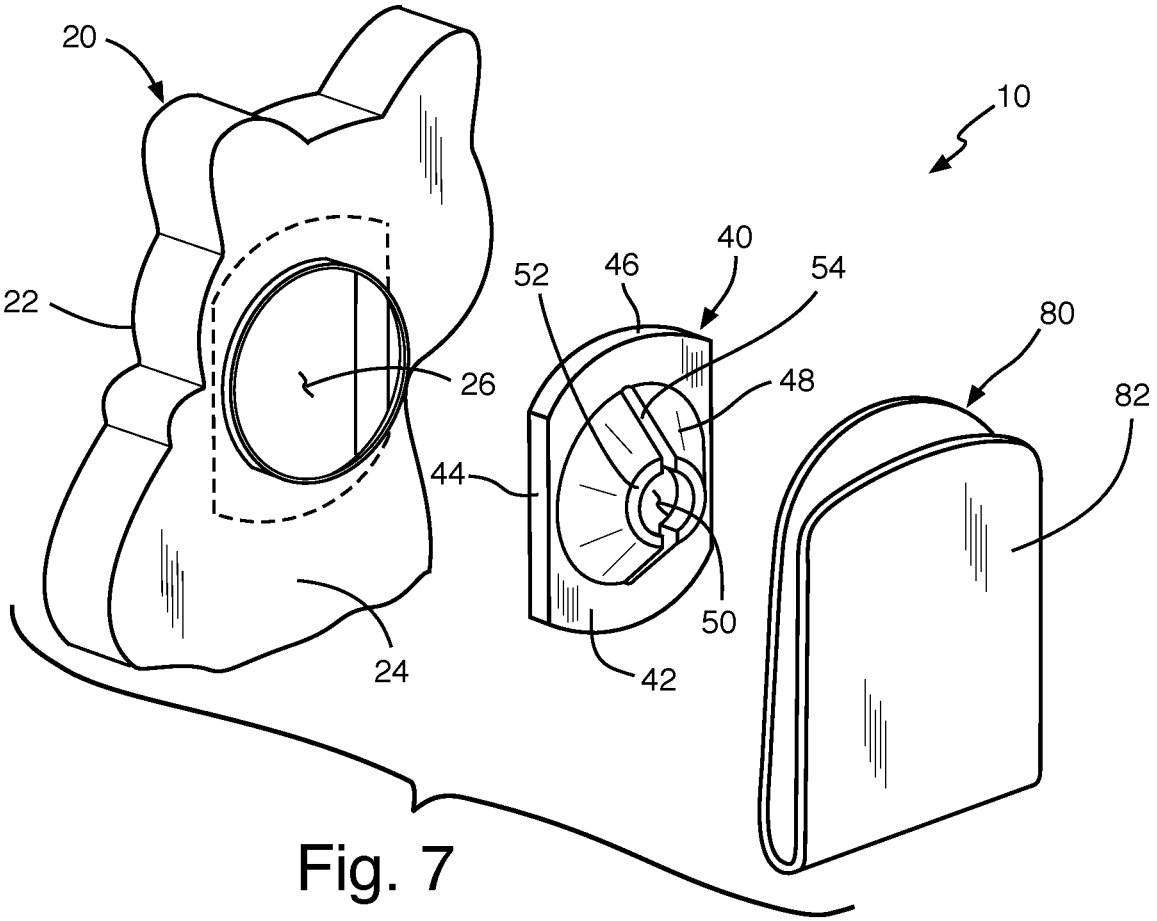
FIG. 7 is a rear exploded view of the present invention with the tension arm assembly.

As seen in FIGS. 5, 6 and 7, in another embodiment, present invention 10 comprises tension arm assembly 80 to secure charm 20. Charm 20 receives post retainer assembly 40, and post retainer assembly 40 receives tension arm assembly 80.

Tension arm assembly 80 comprises tension arm 82. Extending from tension arm 82 is post 84 having head 86 at its distal end.

Figure 8:
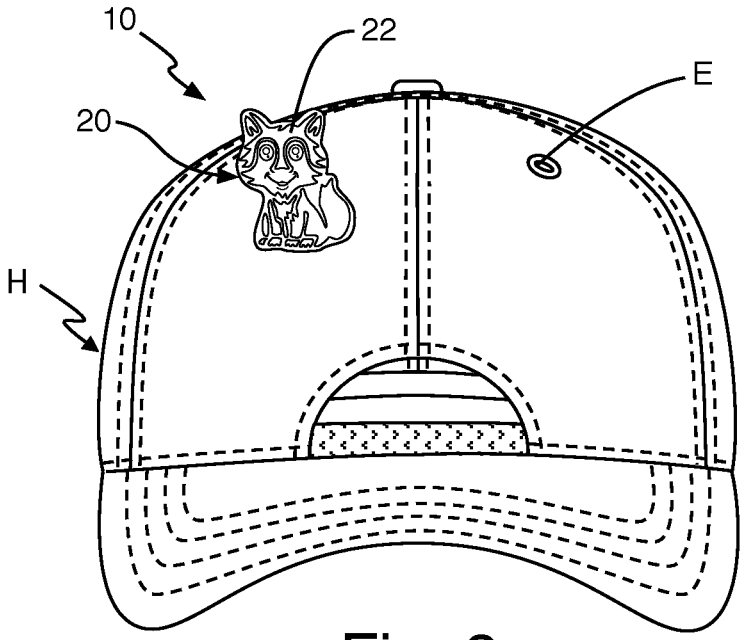
FIG. 8 is a rear view of a headgear with the present invention mounted thereon with the post assembly.
Figure 9:
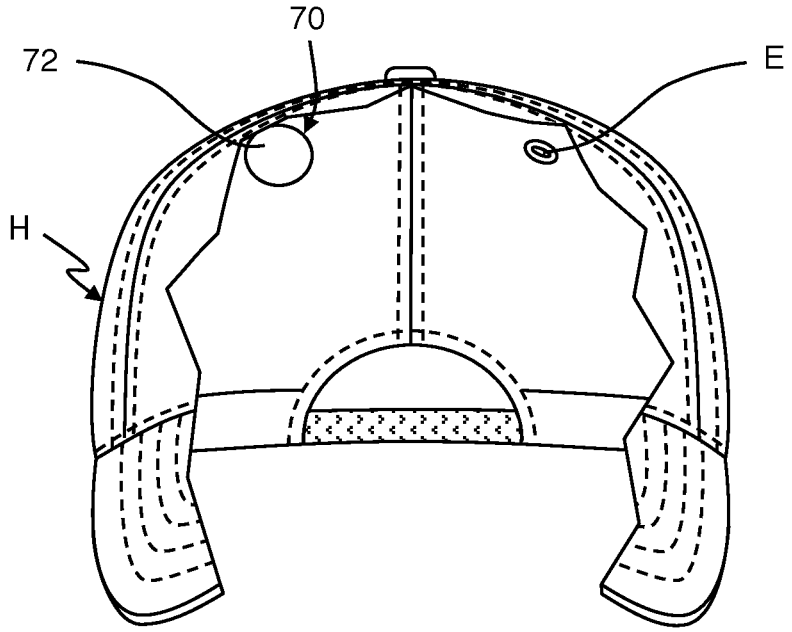
FIG. 9 is a front view of the headgear partially cross-sectioned to show the interior section of the headgear crown and the present invention mounted thereon with the post assembly.

As seen in FIGS. 8 and 9, present invention 10 is mounted on headgear H. Present invention 10 mounts onto headgear H without affecting the headgear's H integrity by utilizing existing eyelets E to receive post assemblies 70. Present invention 10 may be mounted onto any section of headgear H having eyelets E. Post assemblies 70 functions to provide optimum comfort to the wearer since backings 72 will accommodate themselves to the shape of the wearer's head.

Charm 20 mounts onto headgear H when respective opening 50, seen in FIG. 2, is aligned with eyelet E, then from an interior section of the headgear crown, head 76, seen in FIG. 2, passes through eyelet E until a respective opening 50 receives a respective head 76.

Figure 10:
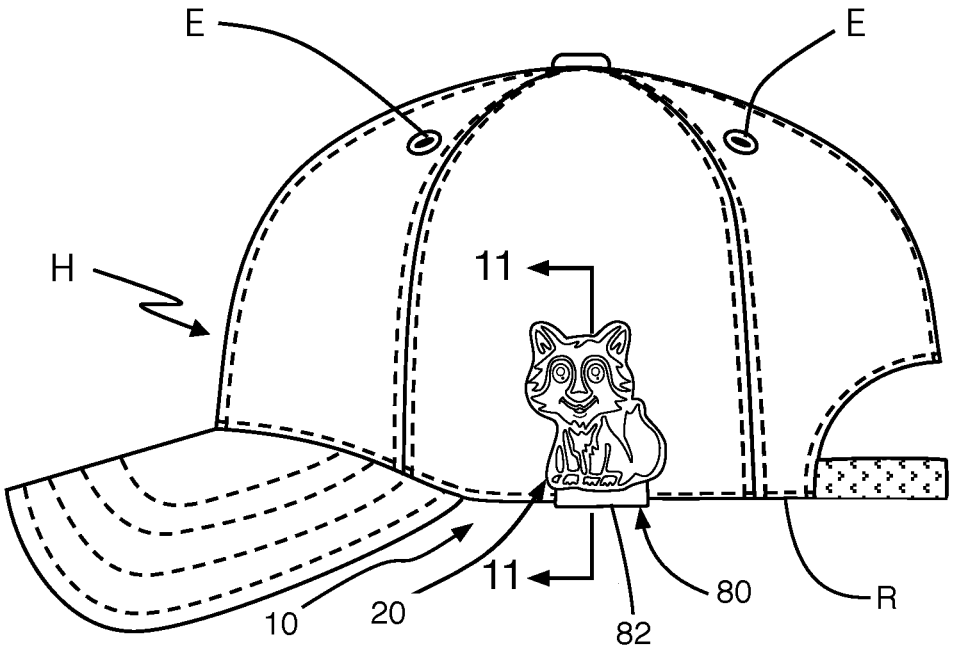
FIG. 10 is a side view of the headgear with the present invention mounted using the tension arm assembly.
Figure 11:
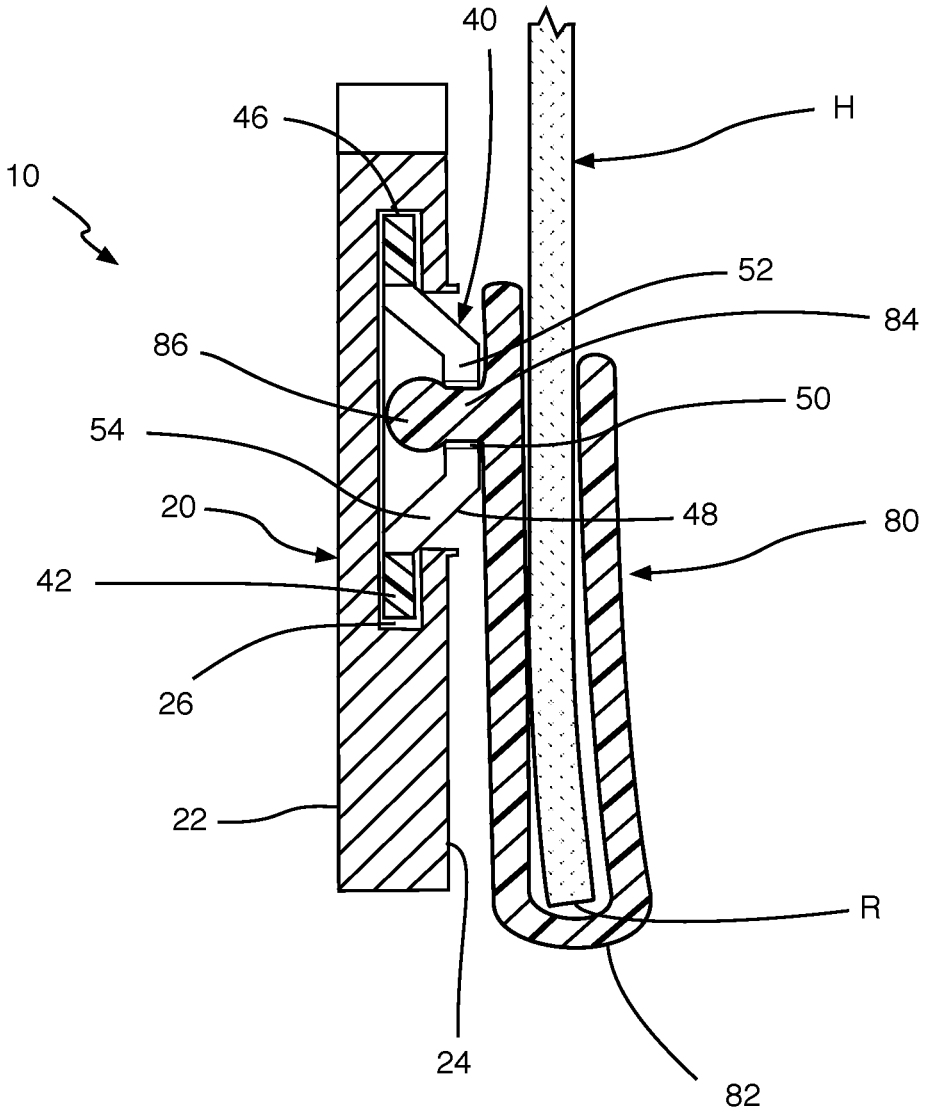
FIG. 11 is a cut view taken along lines 11-11 from FIG. 10.

As seen in FIGS. 10 and 11, present invention 10 also mounts onto headgear H secured by tension arm assembly 80. Charm 20 mounts onto headgear H without affecting integrity of headgear H.

As seen in FIG. 11, tension arm assembly 80 removably mounts into post retainer assembly 40, whereby opening 50 is of a cooperative shape and dimension to removably receives and retains head 86. It is noted that a predetermined force is required for opening 50 to receive respective head 86. Tension arm 82 receives rim R of headgear H. Tension arm 82 has sufficient tension force to keep present invention 10 securely mounted thereon.

In a preferred embodiment, headgear H is a baseball styled cap defined as a type of soft cap with a rounded crown and a stiff peak projecting in front. The front of the cap typically contains designs or logos of sports teams, namely baseball teams, or names of relevant companies, when used as a commercial marketing technique. The back of the cap may be "fitted" to the wearer's head size or it may have a plastic, "VELCRO", or elastic adjuster so that it can be quickly adjusted to fit different wearers. The baseball cap is a part of the traditional baseball uniform worn by players, with the brim pointing forward to shield the eyes from the sun. The cap is also often seen in everyday casual wear.

Figure 12:
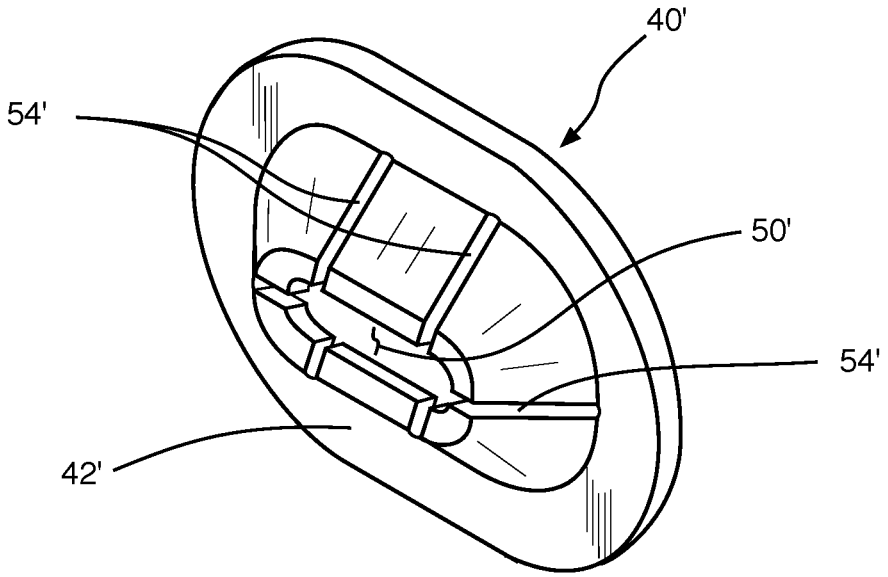
FIG. 12 is an isometric view of an alternative configuration of a post retainer assembly.

As seen in FIG. 12, in another embodiment, post retainer assembly 40, seen in FIG. 2, is an elongated post retainer assembly 40', wherein opening 50' is elongated in shape. Post retainer assembly 40' comprises six elongated apertures 54' extending from base 42' to hole 50'. The elongated shape of opening 50' allows adjusting for different distances between eyelets E, seen in FIG. 10, in an alternative configuration, wherein charm 20' receives two post assemblies 70' and 70", as seen in FIG. 13.

Figure 13:
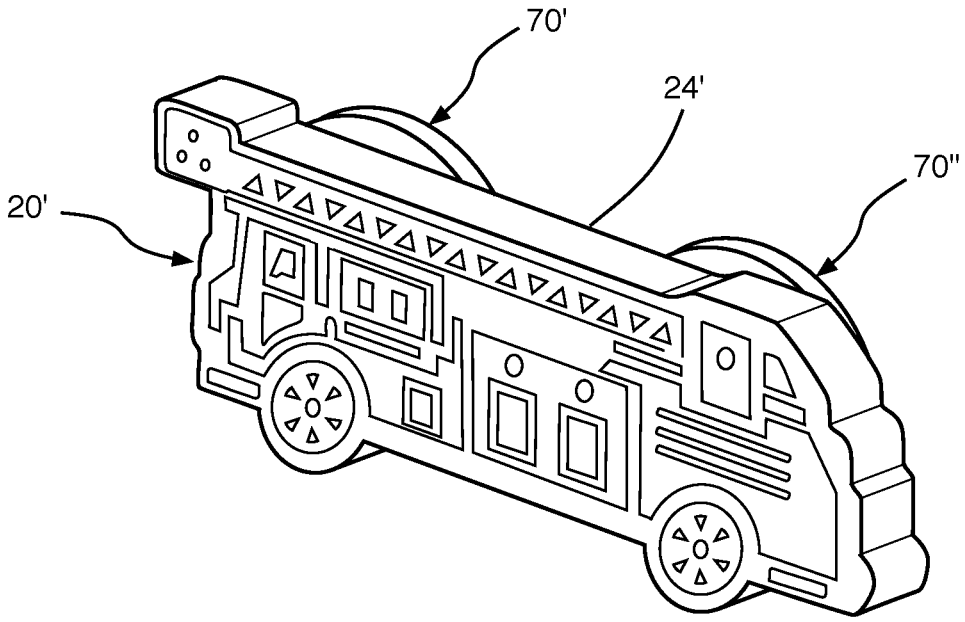
FIG. 13 is an isometric view of an alternative configuration of the present invention.

As seen in FIG. 13, present invention 10 has an alternative configuration comprising charm 20'. Charm 20' comprises interior face 24' having two holes 26, like that seen in FIG. 3, which receive post assemblies 70' and 70" respectively, securing charm 20' at both ends. Holes 26 of charm 20' are of a cooperative shape and dimensions to removably receive respective post retainer assemblies 40 and 40', as seen in FIGS. 2 and 12 respectively, and respective post assemblies 70' and 70".

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A charm for headgear, comprising:

A) a charm having an exterior face and an interior face;

B) at least one post retainer assembly comprising a base and a convex structure, said convex structure comprises an opening and elongated apertures; and C) securing means comprising at least one post assembly to secure said charm onto a headgear, wherein said charm receives said at least one post retainer assembly, and said at least one post retainer assembly receives a respective said post assembly.

2. The charm for headgear set forth in claim 1, further characterized in that said interior face comprises at least one hole.

3. The charm for headgear set forth in claim 2, further characterized in that said at least one hole is of a cooperative shape and dimension to removably receive a respective said post retainer assembly.

4. The charm for headgear set forth in claim 2, further characterized in that said base is inserted into said and remains secured therein, and said convex structure is exposed at said hole.

5. The charm for headgear set forth in claim 1, further characterized in that said base comprises straight sides and curved sides.

6. The charm for headgear set forth in claim 5, further characterized in that said straight sides are opposite each other.

7. The charm for headgear set forth in claim 5, further characterized in that said curved sides are opposite each other.

8. The charm for headgear set forth in claim 1, further characterized in that said convex structure extends from said base.

9. The charm for headgear set forth in claim 1, further characterized in that said opening comprises and opening edge.

10. The charm for headgear set forth in claim 9, further characterized in that said opening edge is plane and parallel to said base.

11. The charm for headgear set forth in claim 1, further characterized in that said elongated apertures extend from said base to said opening.

12. The charm for headgear set forth in claim 1, further characterized in that said at least one post assembly comprises a backing, extending from said backing is a post having a head at its distal end.

13. The charm for headgear set forth in claim 12, further characterized in that said opening is of a cooperative shape and dimension to removably receive and retain said head.

14. The charm for headgear set forth in claim 12, further characterized in that said charm mounts onto said headgear having eyelets without affecting integrity of said headgear by utilizing said existing eyelets to receive said at least one post assembly.

15. The charm for headgear set forth in claim 14, further characterized in that said charm mounts onto said headgear when a respective said post retainer assembly is inserted into said charm and said opening is aligned with a respective of said eyelets, and from an interior section of a crown of said headgear, and said head passes through said respective of said eyelets until a respective said opening receives a respective said head.

16. The charm for headgear set forth in claim 1, further characterized in that said at least one post assembly removably mounts into said at least one post retainer assembly.

17. The charm for headgear set forth in claim 1, further characterized in that said securing means to secure said charm onto said headgear comprises a tension arm assembly.

* * * * *